US006134416A

United States Patent [19]

Tamiya

[11] Patent Number: 6,134,416

[45] Date of Patent: Oct. 17, 2000

[54] IMAGE FORMING APPARATUS HAVING A TRANSFER ELECTRODE

[75] Inventor: Takahiro Tamiya, Tokyo, Japan

[73] Assignee: Ricoh Company, Ltd., Tokyo, Japan

[21] Appl. No.: 09/227,353

[22] Filed: Jan. 8, 1999

[30] Foreign Application Priority Data

Jan. 8, 1998 [JP] Japan ..... 10-013189
Nov. 13, 1998 [JP] Japan ..... 10-341045

[51] Int. Cl.[7] ..... G03G 15/16

[52] U.S. Cl. ..... 399/313; 399/314; 399/176; 361/225

[58] Field of Search ..... 399/313, 314, 399/298, 174, 176; 361/225

[56] References Cited

U.S. PATENT DOCUMENTS 5,438,398 8/1995 Tanigawa et al. .
5,570,162 10/1996 Sohmiya .
5,596,391 1/1997 Matsushita et al. ..... 399/45
5,599,645 2/1997 Tamiya et al. .

FOREIGN PATENT DOCUMENTS 8-063014 3/1996 Japan .
8-146710 6/1996 Japan .
8-220900 8/1996 Japan .
8-328351 12/1996 Japan .
9-006092 1/1997 Japan .
9-305004 11/1997 Japan .

*Primary Examiner*—Richard Moses
*Attorney, Agent, or Firm*—Oblon, Spivak, McClelland, Maier & Neustadt, P.C.

[57] ABSTRACT

An image forming apparatus, such as a color image forming apparatus using a transfer roller or similar transfer electrode, and a constant current power source. The transfer roller is made of a material to which ion agents are added. The constant current power source applies the electric current to the transfer electrode so as to implement an image transfer operation. An electric resistance of the material satisfies a formula log R (Va)−log R (10×Va)≦0.5, such that a quality of the image transfer operation is not corrupted when a relatively little amount of toner is transferred, or a relatively large amount of toner is transferred.

15 Claims, 4 Drawing Sheets

IMAGE FORMING APPARATUS HAVING A TRANSFER ELECTRODE

BACKGROUND OF THE INVENTION

1. Field of the Invention

The present invention relates to a transfer mechanism, as well as system and machine that incorporate the transfer mechanism, that transfers an image forming substance from one surface to another surface. More particularly, the invention relates to copying machines, printers, facsimile machines and similar image forming apparatuses that include an intermediate transfer element for transferring an image, and in particular, a color image as part of an image forming process.

2. Discussion of the Background

In the imaging art, there has been proposed a system wherein a transfer electrode, for example, a transfer roller, having a voltage applied thereto is held in contact with an image carrier in order to transfer a toner image from the image carrier to a recording medium. This kind of transfer system is desirable from an environmental and energy saving standpoint, primarily because the system does not rely on electron discharge, and thus produces a minimum of ozone and saves power.

A transfer roller that is frequently used as such a transfer electrode is referred to herein as a type A transfer roller and has a conductive core, or shaft, and a conductive layer formed on the shaft. The conductive layer is made from conductive fine grains, for example, carbon black or metallic grains, including titanium oxide or tin oxide, which may be dispersed in an insulating material, for example, EPDM (Ethylene propylene diene copolymer) silicon rubber.

By mixing a large amount of conductive grains, the type A transfer roller obtains a predetermined electric resistance value. However, due to difficulty in uniformly distributing the grains, the electric resistance value is less than perfectly uniform over the type A transfer roller. Consequently, the electric resistance of the type A transfer roller varies with the voltage applied thereto. Assuming the transfer roller is a type A roller, the applied voltage or current noticeably changes based on Ohm's law (E=IR), and this change adversely affects the image transfer characteristic of the device that uses the transfer roller and causes unsatisfactory image transfer operations.

To solve the above-described problems, a transfer electrode has been proposed, configured as a transfer roller, that has the conductive layer made of EPDM silicon rubber to which is added various kinds of metal ion salts, surface active agents or similar ionic agents. These additives help to reduce the dependency on the resistivity on the material on the applied voltage. However, as presently recognized, a problem that remains is that the characteristics of the material used for the roller are susceptible to the environment, particularly humidity, since the metal ion salts, the surface active agents or similar ionic agents absorb water. As a consequence, the electric resistance of the material changes depending on the environment.

Examples of devices where the electrical resistance is susceptible to environmental conditions is the device described in Japanese Laid-Open Patent Publication No. 8-220900, which describes a conductive roller produced by altering ion conductivity by incorporating a tetra butyl ammonium salt with urethane foam. Further, Japanese Laid-Open Patent Publication No. 08-328351 describes a conductive roller produced by adding ionic conductive material with the conductive base material by incorporating a NBR (acrylonitrile butadiene copolymer) rubber. Japanese Laid-Open Patent Publication No. 8-63014 discloses a conductive roller produced by mixing the conductive filler with rubber having a specific volumetric resistance. However, producing such conductive rollers in a cost effective manner is a challenge, and the incentive for overcoming this challenge is tempered by the relatively narrow characteristic transfer limits, as will be discussed, associated with such rollers.

Using such intermediate transfer elements in a color image forming apparatus presents other problems. For example, in a color image forming apparatus, separate toner images of each of the color components are formed on a photoconductive element in separate operations. Subsequently, the color toner images are transferred as separate toner images to the intermediate transfer element and later transferred to a recording medium, where the separate color images are made to be superimposed on one another on the recording medium so as to make a composite color image. In this situation, an image reproducibility problem arises when a type A transfer roller is used. In particular, reproducibility of a color, a part of a small amount of toner deposition on the intermediate transfer element, for example, mono-color toner (yellow, magenta, cyan or black) and a part of a large amount of toner deposition on the intermediate transfer element, full-color toner (yellow, magenta, cyan and black) becomes noticeably worse. The cause of the above-described reproducibility problem is not total clear, but the present inventor has made several observations that help to better characterize the problem and subsequently mitigate the problem.

First of all, an appropriate transfer efficiency depends upon a charge density established by an applied current. Assume that an electric resistance of the transfer roller differs between a part that will transfer a portion of the image having a small amount of toner to another part that will transfer another portion of the image having a large amount of toner. Under these conditions, the applied voltage will noticeably change across the transfer roller, and consequently, the efficiency of toner transfer from the intermediate transfer element to the recording medium may be adversely influenced by the combination of spatially variant toner amount-and applied voltage, which themselves are influenced by the image to be printed and the lack of resistance uniformity on the transfer roller.

When using the type A transfer roller, its electric resistance distribution noticeably changes, thereby the current which is applied from the transfer roller to the intermediate transfer noticeably changes for one image. Consequently, the charge density established by the applied current, so as to obtain the appropriate transfer efficiency, noticeably differs between the respective parts of the image. This difference is significant in the case of forming color images because the amount of toner actually deposited for the separate uni-color images varies substantially. A smallest amount of deposited toner occurs, for instance, when a uni-color image is printed with a low gray scale measurement and a highest amount of deposited toner occurs for an image having a high gray scale measurement and 4 overlapping/superimposed colors. Moreover, when the range of toner deposition varies greatly, the non-uniform charge distribution effect of the type A roller on image quality becomes noticeable and significant. Once again, the source of this problem may be attributable to the non-uniformity of the type A roller resistance and associated charge distribution, particularly in a color image forming operation, Further explaining the problem, when using the transfer roller of type A in a color image forming apparatus that selectably places the roller in contact with the intermediate transfer element, an unsatisfactory image transfer of the color toner image from the intermediate transfer element to a leading edge of the recording medium is observed. The unsatisfactory image transfer is referred to as having a so-called transfer hollow. In case of the color image forming apparatus including the intermediate transfer element, the transfer roller is separated from and moved to contact the intermediate transfer element. When contacting the intermediate transfer element, a part of the transfer roller is compressed and deformed at a transfer nip portion where the intermediate transfer element and the transfer roller contact one another. As a consequence, an electric resistance of the compressed and deformed part of the transfer roller decreases.

The decrease of electric resistance is presumably due to the fact that when the roller is compressed, it is easier to move electrons between dispersed conductive fine grains and thus the current between the transfer roller to the intermediate element noticeably increases. Provided that the current is returned to normal after an appointed time by using a constant current power source, minimal harm is done. However, a performance problem manifests itself in that a transfer hollow occurs at a leading edge of the recording medium which corresponds to when the surge of current was present.

SUMMARY OF THE INVENTION

The present invention has been made in view of the above-described and other problems and therefore it is an object of the present invention to address and correct these problems. To this end, an image forming apparatus with an inexpensive transfer device is provided that has a stable transfer characteristic immune to the environment and change in applied voltage.

Another object of the present invention is to provide a color image forming apparatus including an intermediate transfer element having a stable transfer characteristic immune to the amount of toner deposition, and operable with an inexpensive transfer system.

It is a further object of the present invention to provide a color image forming apparatus including an intermediate transfer element having a stable transfer characteristic immune to the change in electric resistance as caused by a compressed and deformed transfer electrode.

BRIEF DESCRIPTION OF THE DRAWINGS

A more complete appreciation of the invention and many of the attendant advantages thereof will readily be obtained as the same becomes better understood by reference to the following detailed description when considered in connection with the accompanying drawings, wherein.

DESCRIPTION OF THE PREFERRED EMBODIMENTS

Figure 1:
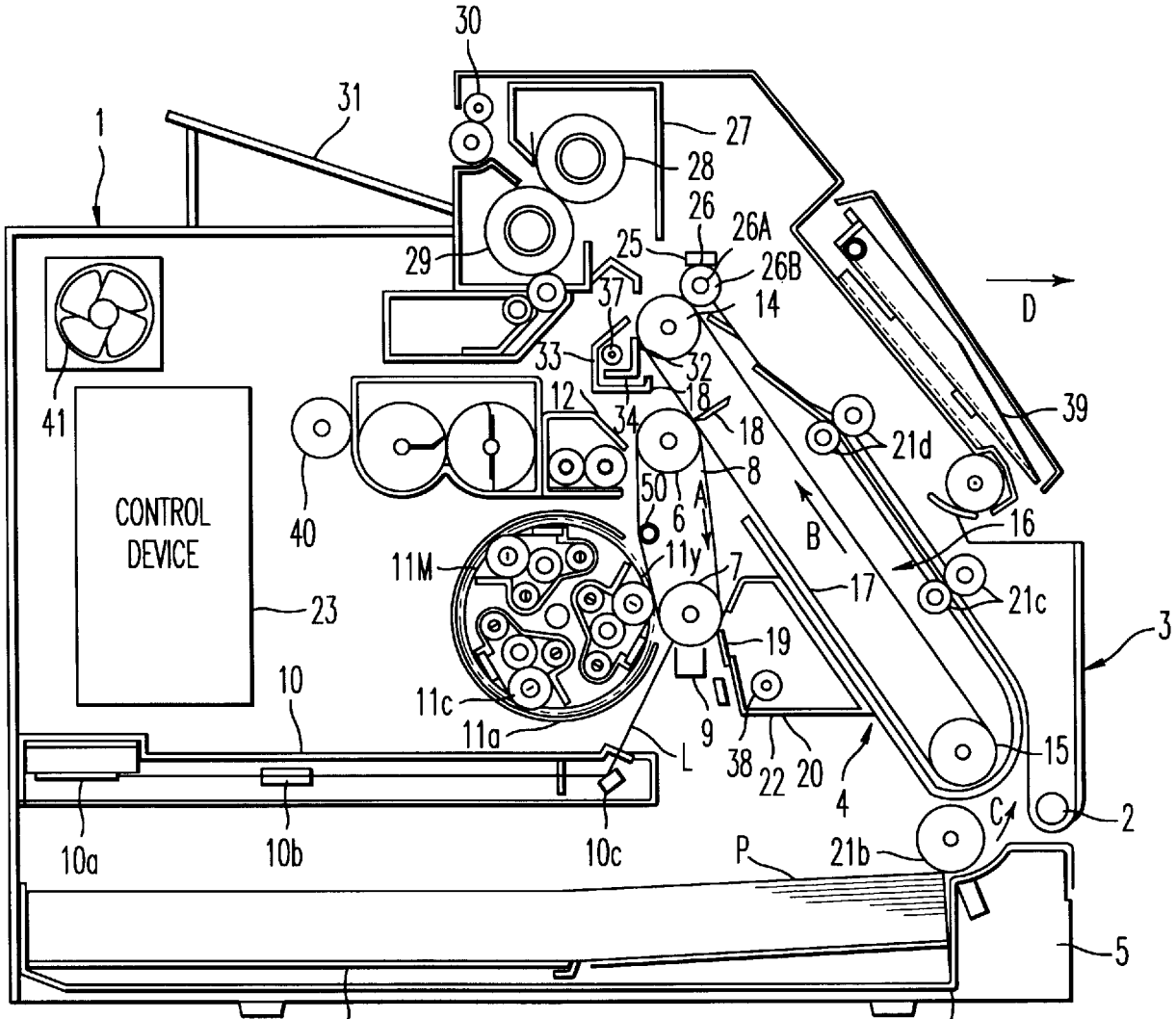
FIG. 1 is a schematic drawing showing a main structure of a color printer as one image forming apparatus embodiment according to the present invention.

Referring now to the drawings wherein like reference numbers describe the same or corresponding parts throughout the several view, and more particularly to FIG. 1, thereof, FIG. 1 shows a color printer as one exemplary image forming embodiment of the present invention. The color printer forms a multi-color image by first performing a latent image operation by processing image data provided by a color image reading device or a personal computer, and superposing separate uni-color images on an intermediate image transfer device, as will be discussed.

As shown in FIG. 1, a color printer 1 is provided with a belt like photoconductive element 8 (hereinafter called photoconductive belt, although a drum may be used as well) which is movably positioned between a drive pulley 6 and a driven pulley 7. The photoconductive belt 8 is movable in a direction indicated by an arrow A, by a drive pulley 6. Furthermore, a tension roller 50 of the photoconductive belt 8 is shown.

A charging device 9 for executing an electrophotographic image forming process, an optical writing device 10, a developing device 11, an intermediate transferring device 16, and a cleaning device 22 are located around the photoconductive belt 8. The optical writing device 10 is provided for optically writing an image of an original document, converting the color image information obtained from a color image reading device or a personal computer or the like into an optical signal. The optical writing device 10 includes a laser light source, a polygon mirror 10*a*, an f-θ lens 10 *b* and a reflecting mirror 10*c*. The laser beam from the laser light source is scanned via the rotating polygon mirror 10*a* at the optical writing device 10, and the electrostatic latent image is formed by leading the laser beam L to the photoconductive belt 8 by the f-θ lens 10*b* and the reflecting mirror 10*c*.

A color developing device 11, in which the developers 11*c*, 11*m*, 11*y*, each having selected color toner, is capable of facing the photoconductive belt 8 resultant from a supporting member 11*a* being selectively rotated for performing a developing operation with a desired color, e.g., cyan, magenta, yellow, in relation to a complementary color with a color spectrum included in the color image information. In this case, the developer which contains color toner is disposed along the peripheral direction of the supporting member 11*a* which is made of a cylindrical member and is hosted in the color developing device 11. A part of the peripheral wall of the supporting member 11*a* which is facing the photoconductive belt 8 is eliminated so as to create an opening, and the developer is capable of supplying toner onto the electrostatic latent image on the photoconductive belt 8 by exposing the developer thereto. The developer facing the photoconductive belt 8 is capable of supplying toner onto the photoconductive belt 4 by way of a driving force from a drive part, and when the toner is changed, the transmission of the drive force is released.

In addition to aforementioned color developing device 11, adjacent to the color developing device 11, a black developer 12 containing black toner is disposed. The black developer 12 is capable of being attached to or detached from the photoconductive belt 8 selectively by an eccentric cam 40. The developing device 8 and the black developer 12 form a toner image by processing image data for an electrostatic latent image which is carried on the photoconductive belt 8.

An intermediate transferring device 16 individually transfers the uni-color toner images respectively processed by the developing device 11 and the black developer 12, (this is called primary transfer) and has a function for transferring after all of the toner images as a secondary transfer. For this purpose, the intermediate transferring device 16 has a belt 17 (hereinafter called intermediate transfer belt 17) which is movably positioned between a drive pulley 14 and a driven pulley 15, and is held for moving in a direction indicated by an arrow B as shown in the figure.

A primary transfer electrode 18, which is composed of a conductive brush, is mounted at a position facing a drive pulley 6 of the photoconductive belt 8 across the intermediate transfer belt 17 from the drive pulley 6 and contacts a back of the photoconductive belt 8, for electrostatically transferring the toner image on the photoconductive belt 8 onto the intermediate transfer belt 17. A secondary transfer electrode 26, hereinafter called transfer roller 26, which is composed of a conductive roller is positioned over, and opposing, the photoconductive belt 8, and across from a drive pulley 14.

An intermediate transfer cleaning unit 35 having a unit case and which is provided with a cleaning member 32 is composed of a blade for cleaning the intermediate transfer surface contactably mounted to the intermediate transfer belt 17, a receiving member 34 for receiving the cleaned toner by the blade 32, a discharging member 37 which is composed of a screw for discharging the received toner from the receiving member 34 respectively disposed downstream of the transfer position of the photoconductive belt 8 in a moving direction of the transfer belt 17.

The transfer roller 26 which has a shaft 26A made of a conductive metal rod and an elastic outer layer 26B formed on the shaft 26A, is used for transferring the images on which have been superposed the intermediate transfer belt 17 onto the recording medium (hereinafter called sheet P, or other image holding member). The separate/contact device 25 is used for separating the transfer roller from and bringing the transfer roller 26 into contact with the intermediate transfer belt 17. The intermediate transfer cleaning unit 35 removes residual toner on the intermediate transfer belt 17 by scraping off the residual toner, after the transfer operation.

The cleaning device 22 is provided with a cleaning member 19 composed of a blade for cleaning the photoconductive belt 8, and is contactably mounted to the photoconductive belt. Also included is a cleaning case 34 for receiving the cleaned toner by the cleaning member 19 and discharging member 38 which is composed of a screw for discharging the received toner from the cleaning case 34. The cleaning member 19 removes the residual toner on the photoconductive belt 8 by scraping off the residual toner after the toner image, which is processed by separately transferring uni-color images from the photoconductive belt 8 to the intermediate transfer belt 17 on top of one another on the intermediate transfer belt 17. An eraser 13, composed of a discharging lamp, is provided for maintaining a predetermined voltage so as to discharge remaining charge on the photoconductive belt 8 after the cleaning process is executed.

The sheet P on which the composite toner image is transferred, from the intermediate transfer belt 17 by the transfer roller 26, is fed out from a sheet feeding device 21. The sheet feeding device 21 is provided with the sheet P feeding cassette 21 mounted in the color printer 2. A feeding roller 21*b* is provided to individually send out the sheet P contained inside of the sheet feeding cassette 21*a*, one-by-one, and a pair of conveying rollers 21*c* are provided and face each other at positions across and along the conveying path C of the sheet P from the sheet feeding cassette 21*a* to the position where the image is transferred. A registration roller 21*d* is provided which sets a sheet feed timing operation before the sheet P reaches the intermediate transfer belt 17.

The sheet P is then sent out from the sheet feeding cassette 21*a* and is conveyed to the registration roller 21*d* by a pair of conveying rollers 21*c*, according to the feed timing set by the registration roller 21*d*. The composite toner image on the intermediate transfer belt 17 is transferred by moving the image to the transfer position where the intermediate transfer belt 17 and the transfer roller 26 face each other. The sheet P carrying the composite toner image thereon is conveyed to a fixing device 27, which includes a heat roller 29 and a press roller 28, and the pair of rollers fix the toner image on the sheet P by heat and pressure. The sheet P discharged from the fixing device 27 is discharged toward a discharging tray 31 by a pair of discharging rollers disposed behind the fixing device 27. In this embodiment, the sheet P is discharged in a same order as the pages are discharged from the fixing device 27, since a side of the intermediate transfer belt 17 of the sheet P which is sent out from the sheet feeding device 21 is the image transferring surface.

A control device 23 controls the color printer 1, and a fan 41 prevents an increase in temperature inside the color printer 1. A by-pass feed table 39 uses a friction feed system for feeding non-standard size paper. The contact timing of the cleaning device 22 and the intermediate transfer cleaning device 35 to the photoconductive belt 8 and the intermediate transfer belt 17 are predetermined so that the residual toner may be scraped off by contacting the photoconductive belt 8 and the intermediate transfer belt 17 at an appropriate time. The contacting times include the time when the photoconductive belt 8 has transferred each uni-color toner image to the intermediate transfer belt 17, when the intermediate transfer belt 17 has finishing transferring the composite toner image, or even a mono-color image.

The color printer 1 is provided with a construction for convenient transfer operations. The photoconductive belt 8, the cleaning device 22, the intermediate transfer belt 17, the intermediate transfer cleaning device 13, a part of the conveying roller 21*c*, a part of the registration roller 21*d* are contained in a unit 4 which is movably positioned around a shaft of a driven pulley 15 of the intermediate transfer belt 17. Another part of the conveying roller 21*c*, another part of the registration roller 21*d*, and the transfer roller 26 are contained in a printer front frame 3 which is movably supported against a main body frame 5 of the printer 1 by a shaft 2 positioned adjacent to the sheet feeding cassette 21*a*.

Figure 2:
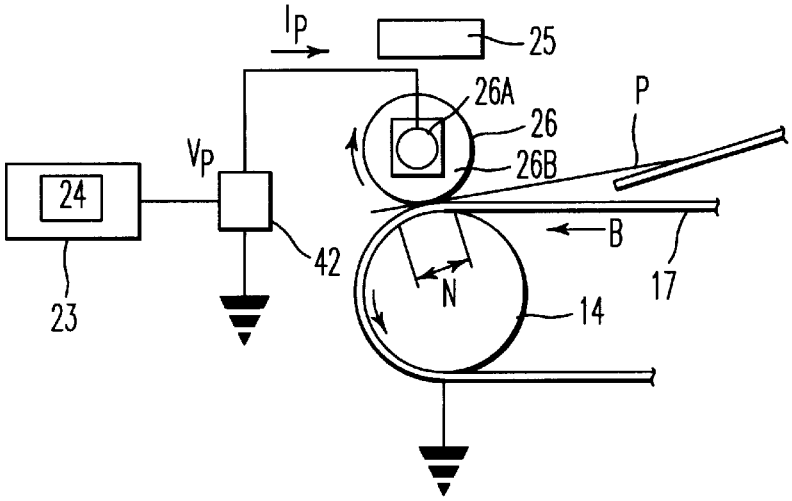
FIG. 2 is an enlarged sectional side view illustration of a transfer device according to the present invention.

FIG. 2 shows an enlarged section of the transfer portion between the transfer roller 26 and the intermediate transfer belt 17. The intermediate transfer belt 17 has a single layer made of PTFE (polyethylene tetrafluoroethylene), PVDF (polyvinalidene fluoride) that is dispersed carbon black. The intermediate transfer belt 17 moves at a speed of 100 mm/sec. The single layer has a film thickness of 150 $\mu$m and a surface resistance in an inclusive range of $1\times10^{7}$ Ω/□ through $1\times10^{10}$ Ω/□. The surface resistance is determined according to "resistivity" defined in JIS K 6911.

The drive pulley 14 which supports the intermediate transfer belt 17 is composed of a roller having a thin rubber layer, it has a diameter of 30 mm, a surface resistance of not more than $1\times10^{10}$ Ω/□ (JISK6911), and it is used for as an opposing electrode facing the transfer roller 26. The coefficient of friction of the drive pulley 14 surface is higher than the intermediate transfer belt 17 surface so as to prevent the intermediate transfer belt 17 from slipping. The transfer roller 26 is composed of elastic outer layer 26B and the conductive shaft 26A, where the elastic outer layer 26B is formed on the shaft 26A and is made of a rubber foam (ex. urethane foam) to which ions agents are added, and a surface hardness of 30 (measured by a rubber hardness tester Asker C), and having a diameter of 17 mm, and a volume resistivity in an inclusive range of $1\times10^{7}$ Ωcm to $1\times10^{10}$ Ωcm. The volume resistivity is determined according to "resistivity" defined in JIS K 6911. This type of the transfer roller is referred to hereinafter as a type B transfer roller.

A contact load of 500 gf is applied between the intermediate transfer belt 17 and the transfer roller. Consequently, the transfer nip portion N where the intermediate transfer belt 17 and the transfer roller 26 contact one another is 3 mm wide.

The constant current power source 42 which is controlled by a control device 23 is provided with a microcomputer 24 that applies an electrical charge to the shaft 26B of the transfer roller 26. In particular, the present invention uses constant current power sources suitable for the application of currents to the type B transfer roller.

An image transferring operation will be described. When the sheet P moves between the intermediate transfer belt 17 carrying the toner image and the transfer roller 26, a constant current Ip flows from the constant current power source 42 which is controlled by the control device 36 to a position where the transfer roller 26 contacts with the sheet P. Thereby, even if the environmental conditions, particularly humidity, noticeably change, the value of current output from the constant current power source 42 is held constant by the control device 36. While the target value of the current to flow through the contact position depends on the kind of the sheet (the size, the quality of the material) or image formation modes for printer, it may be 10 μA to 80 μA, for example.

In the present embodiment, the transfer roller 26 using the type B transfer roller and the constant current power source 42 are combined to ensure image quality. Moreover, this combination ensures stable charge deposition without resorting to, for example, using a costly special transfer roller having voltage control. This transfer system is also capable of adapting to changes in environment characteristics in that the voltage changes due to a change in the output power sources during the course of operation and compensating for an unevenness of product quality (e.g., the resistance of transfer rollers).

As stated above, in the illustrative embodiment, the image forming apparatus is capable of using the type B transfer roller whose the electric resistance changes depending on the environment. While the transferring mechanism described above is implemented as the type B transfer roller, it may be implemented as an another transfer roller having a rubber foam layer to which ions agents are added and in which fine conductive grains are dispersed. This latter type of roller will be referred to herein as a type C transfer roller. A characteristic feature of the type C roller is that an influence on the roller resistance, which is a type of electric characteristic, is influenced to a greater extent by the ion agents than the conductive fine grains.

Figure 3:
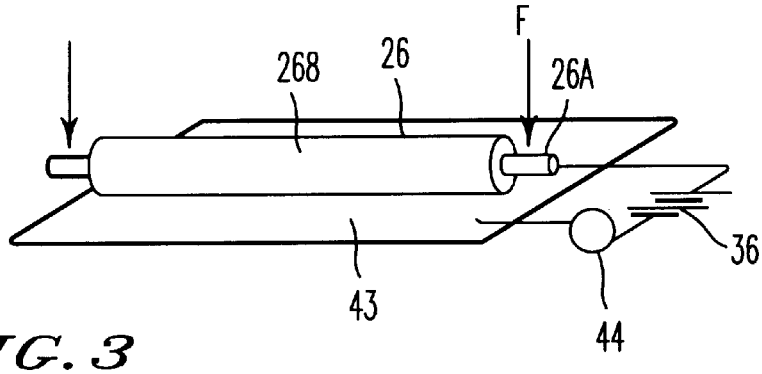
FIG. 3 is a profile view of an arrangement for measuring voltages respectively applied to a transfer roller of type A, type B and type C.

A color image transfer system which uses the type B transfer roller will now be described. FIG. 3 is a graph that shows a specific arrangement for measuring the voltage applied to type A, B and C transfer rollers. The voltage applied to the transfer rollers is measured as follows. As shown in FIG. 3, the transfer roller 26 is placed on a metal plate 43, and a load of 500 gf is applied on both ends of the transfer roller 26, respectively. Then, a predetermined output (current) from a power source 36 is applied to measure the voltage between the shaft 26A and the surface of the outer layer 26B by an ammeter 44.

Figure 4:
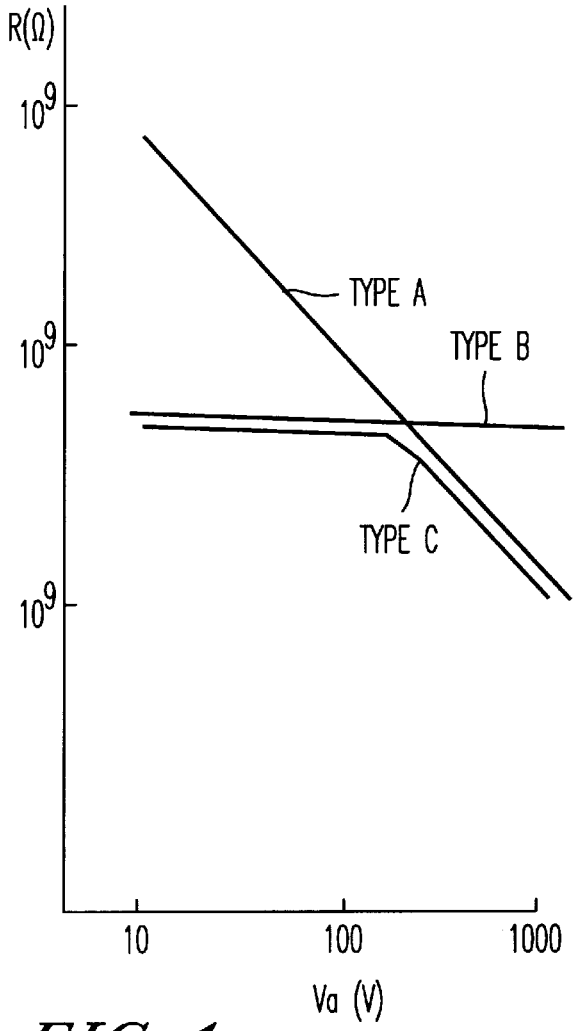
FIG. 4 is a graph indicating a relation between an electric resistance of the respective transfer rollers of type A, type B, and type C.

FIG. 4 is a graph indicating a relation between the electric resistance of the different transfer rollers—i.e., types A, B and C according to the measurements taken with the setup shown in FIG. 3. As shown in FIG. 4, the type A transfer roller has a voltage-to-resistance characteristic that shows the resistance noticeably decreasing with an increase in voltage (shown as a monotonic negative slope). In contrast, the type B transfer roller has a voltage-to-resistance characteristic that is nearly uniform for increasing voltage. The type C transfer roller has a voltage-to-resistance characteristic that is somewhat of a hybrid of type A and type B because the characteristic is uniform for lower voltages, but decreases for higher voltages.

Figure 5A:
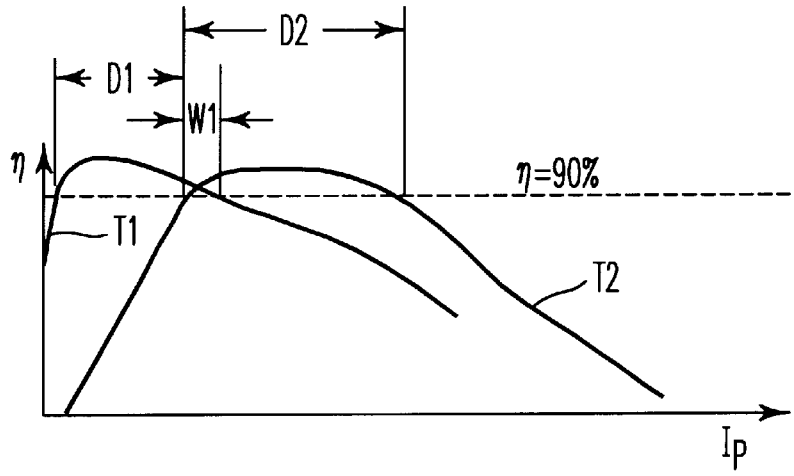
FIGS. 5A and 5B are graphs respectively indicating a relation between the transfer efficiency of the transfer roller of type A and the applied current and a relation between the transfer efficiency of the type B transfer roller and the applied current.
Figure 5B:
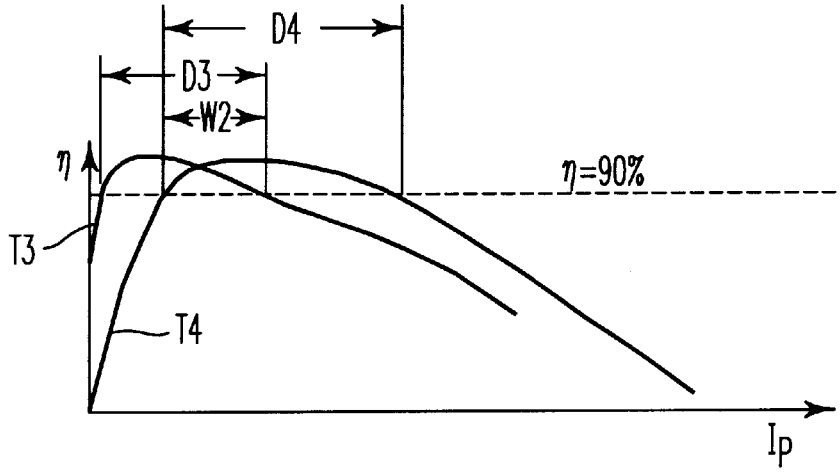

FIGS. 5A and 5B are graphs respectively indicating a relation between the transfer efficiency of the type A and B transfer rollers and the applied current. To evaluate the transfer efficiency, the type A transfer roller and type B transfer roller each were mounted to the color printer 1 shown in FIG. 1. The transfer efficiency η was calculated by use of the following equation:

$$\eta(\%)=AP/AI\times100,$$

where AP is an amount of toner deposition on the sheet P after the secondary transfer, and AI is an amount of toner deposition on the intermediate transfer belt 17 before the secondary transfer.

In this embodiment, the transfer efficiency on the sheet P of the type A transfer roller and type B transfer roller, respectively, was evaluated after the secondary transfer in the mono-color, or uni-color mode setting with an efficiency of the toner deposition set to 10% and the full color mode setting with the efficiency of the toner deposition set to 400%, and then a desirable transfer efficiency criteria was established as being greater than 90%.

The efficiency of the toner deposition γ is calculated by use of the following equation:

$$\gamma(\%)=AU/AP\times100,$$

where AP is an amount of toner deposition on the intermediate belt 17 after the developing in a condition of all complete toner deposition, and AU is an amount of toner deposition on the intermediate transfer belt 17 after the developing in a condition of the course of operation.

As shown in FIG. 5A, the type A transfer roller, in the case of the efficiency of the toner deposition being 10%, has a current-to-transfer efficiency characteristic T1, as shown. A desirable value of current required to obtain a transfer efficiency of at least 90% is within the range D1. T2 is a current-to-transfer efficiency characteristic representative of the case where the efficiency of toner deposition is 400%. As is seen, a desirable current which can achieve a transfer efficiency of at least 90% is within the range D2.

In view of the respective ranges D1 and D2, an overlapping desirable range of current is represented as W1, which empirically was measured to be about 1 μA. The range W1 is representative of the acceptable amount of current supplied that can provide adequate performance for both the 10% toner deposition situation and the 400% toner deposition situation. Moreover, because the range W1 is so narrow, extremely tight control over a type A roller would be required to support adequate performance in a color printing apparatus. Of course, the ability to control the current within this tight range might be prohibitively difficult, and expensive, in operational conditions were the ambient environment changes from time to time.

On the other hand, as shown in FIG. 5B, the type B transfer-roller, in the case of the efficiency of the toner deposition being 10%, has a current-to-transfer efficiency characteristic T3. The region D3 shows where T3 meets or exceeds the 90% transfer efficiency threshold. T4 is representative of the current-to-transfer efficiency characteristic where the toner deposition of 400% was applied. D4 shows where T4 meets or exceeds the 90% transfer efficiency threshold. The overlapping range between D3 and D4 is shown as W2, which was empirically measured as being 10 μA. Comparing W1 to W2, W2 is ten times wider than W1, thereby enabling a more practical and cost efficient solution to controlling the current under varying environmental conditions and uncertain manufacturing tolerances.

Interpreting these results, by virtue of the resistivity of the type B transfer roller being relatively independent of the applied voltage (see, e.g., FIG. 4), the use of a type B roller in a color image forming apparatus offers a wide range of the charge density (and relatedly the applied current) while remaining immune to performance degradation. Consequently, a reproducibility of a color image is preserved even when only a little amount of toner is transferred to the intermediate transfer element on one part of the image area and where a large amount of toner is deposited on the intermediate transfer element for another part of the image area (i.e., the gray scale dynamic range varies dramatically within a single image). Under these conditions, and particularly for color transfer systems where a larger disparity of toner amounts is present (due to the overlapping of uni-color images), a stable and cost effective transfer characteristic is provided.

While not expressly shown in a figure, similar characteristics for the type C transfer roller provide ranges of W3 (4 μA) and W4 (1 μA) for temperatures of 30° C. and 90% humidity, and under the condition of a temperature 10° C. and 15% humidity.

The transferring mechanism described above is preferably implemented as the type B transfer roller, although it may also be implemented as the type C transfer roller. In addition, the power source for above the color printer preferably uses a constant current power source.

Regarding the relationship between the transfer characteristic and the electric resistance of the transfer roller (a dependance on the applied voltage of the transfer roller), the type A, B and C transfer rollers have a value of the applied voltage measured between the shaft 26A and the surface of the outer layer 26B, as measured by the measuring device shown in FIG. 3. The electric resistance for each transfer roller is calculated according to Ohm's law. The transfer characteristic and the electric resistance of the resulting transfer rollers are shown in Table 1. In table 1, each electric resistance indicates an electric resistance (log Ω) from the shaft to the surface, respectively. In table 1, the formula $$\Delta R\ (Va)\ \log R\ (Va) - \log R\ (10 \times Va)$$

indicates a dependence on the applied voltage of the electric resistance of the transfer roller. Generally, a range of the voltage used for the image transfer is from 10 V to 100 V. In the experiments, each "log R (Va)" is a resistance when each applied voltage is 10 V, 25 V, 50 V, 100 V, and each "ΔR (Va)" is calculated by the above formula, respectively.

TABLE 1

| | ΔR (Va) | W | T |
|---|---|---|---|
| Type A | 1 or more | 1 μA | 1 |
| Type B | 0.3 or less | 10 μA | 4 |
| Type C | | | |
| Condition H | 0.5 or less | 4 μA | 3 |
| Condition L | 1 or more | 1 μa | 1~2 |

In table 1, "W" indicates values of the current range W1, W2, shown in FIGS. 5A and 5B, as well as the ranges W3 and W4 discussed above. "T" indicates the results of the transfer characteristic ranked "1 (lowest) to 4 (highest)". "H" indicates a temperature of 30° C. and humidity of 90%, and "L" indicates a temperature of 10° C. and a humidity of 15%.

As the results of the above described experiments indicate, the type B transfer roller has outstanding transfer characteristics within a wide current range, over a large toner deposition dynamic range. Moreover, to obtain a desirable image transfer characteristic within wide limits requires providing the transfer roller having the above described electric resistance ΔR (Va) of 0.5 or less (Type A or C). More specifically, the electric resistance ΔR (Va) is desirably 0.3 or less.

Figure 6:
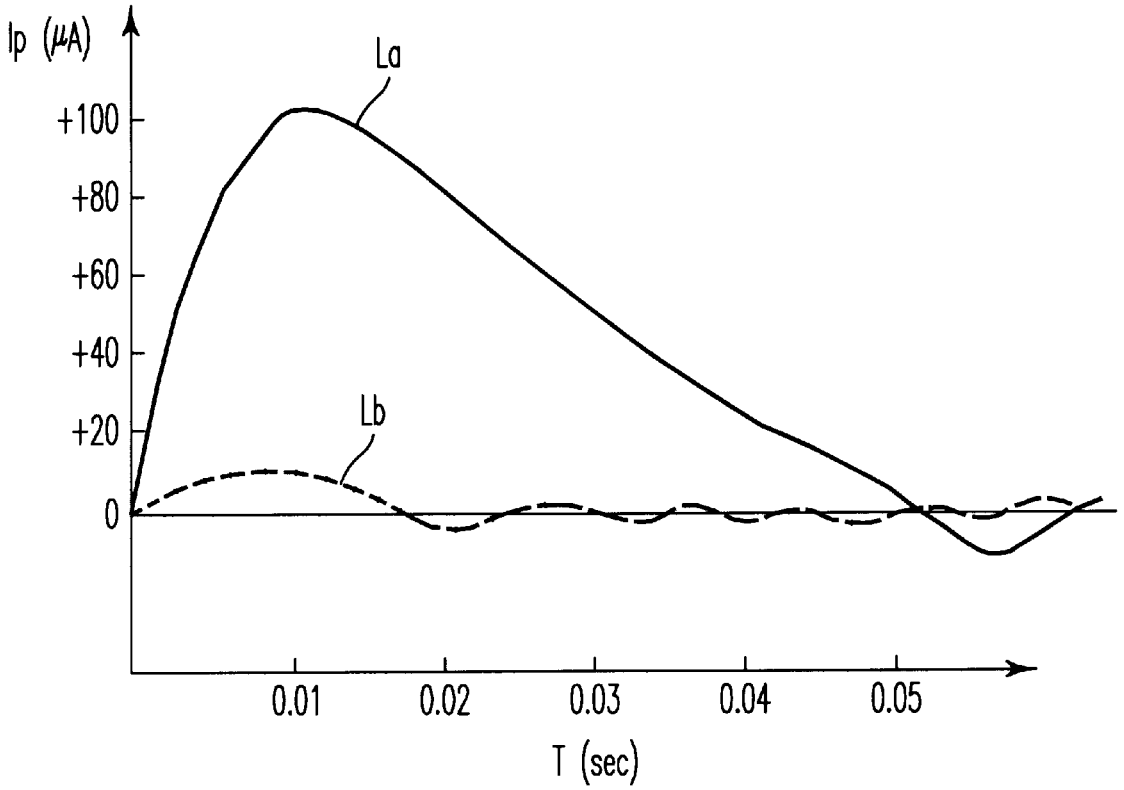
FIG. 6 is a timing diagram showing the applied current to the transfer roller of type A and the type B transfer roller.

FIG. 6 is a timing diagram showing the applied current to the type A transfer roller and B transfer roller. In the embodiment, the circumferential speed of the intermediate transfer belt 17 is set to 100 mm/sec, a value of current flowing is detected every 0.01 sec, the current value output from the power source 42 is controlled to be the target value of the current (20 μA) by the control device 23. In other words, an interval of the current control is 0.01 sec, a control timing of the current value output is to be for every 1 mm forward movement of the sheet P.

In FIG. 6, "La" indicates the time course of the current which flows from the constant current power source 42 to a contact position where the transfer roller 26 (type A) contacts the intermediate transfer belt 17 after the transfer roller 26 (type A) is in contact with the intermediate transfer belt 17. When using the type A transfer roller, the current noticeably increases within a first interval of the current control and reaches the 100 μA point after the transfer roller 26 is contacted with the intermediate transfer belt 17. Consequently, the control device 23 controls the current value output from the power source 42 for returning the value of the increased current into the target value of the current (20 μA) at the time of detecting the current after the first interval of the current control. However, the value of the increased current is not able to return to the target value of the current (20 μA) within a second interval of the current control as a result of too large of an increase in current. Consequently, an unsatisfactory transfer of the toner image occurs.

Accordingly, when the value of the increased current returns to the target value of the current (20 μA) after 0.05 sec, the transfer hollow is produced on the sheet P at a position within 5 mm in the length of the contact point, a distance to which corresponds to the above described 0.05 sec, from the leading edge of the sheet P. Generally, it is extremely difficult to closely regulate the transfer current within such a short period. The close regulation of the transfer current within such a short time period requires an expensive power source. Thus, such an apparatus is of limited practical use.

In FIG. 6, "Lb" indicates the time course of the current that flows from the constant current power source 42 to a contact position where the transfer roller 26 (type B) contacts the intermediate transfer belt 17 after the transfer roller 26 (type B) is contacted with the intermediate transfer belt 17. When using the type B transfer roller, the current is substantially constant without regard to contact/separation of the transfer roller. This is presumably attributable to the resistance of the type B transfer roller remaining relatively constant when compressed or deformed.

Moreover, while the transferring mechanism described above is preferably implemented as the type B transfer roller, it may be implemented as the type C transfer roller as well.

Various modifications will become possible for those skilled in the art after receiving the teachings of the present disclosure without departing from the scope thereof.

Although the above-mentioned embodiment is explained with the photoconductive belt 8 as the photoconductive element, a drum-shaped photoconductive element may also be used.

Although the above-mentioned embodiment is explained with the intermediate transfer belt 17 as the intermediate element, a drum-shaped, a roller-shaped or the like may also be used. Although the transfer roller 26 is the transfer electrode described in the present embodiment, other contact types of transfer electrode such as a transfer brush, a transfer blade, a transfer belt or the like which contact the image carrier for transferring the image may be used as well.

Although the above-mentioned embodiment is explained with the outer layer 26B, a rubber foam, solid rubber, elastic rubber (made from EPDM, silicone or the like) to which is added various kinds of metal ion salt, surface active agents or similar ionic agents may also be used.

Although the above-mentioned embodiment is explained with the electric characteristic (volume resistivity), the surface hardness, the contact load with the intermediate transfer element and structure (single layer, double layer or the like) of the transfer roller 26 may also be suitably selected in matching relation to various conditions including image forming conditions.

The present document is based on Japanese Patent Application No. 10-013189 filed in Japan on Jan. 8, 1998, and Japanese Patent Application No. 10-341045 (Ricoh No. JP98-6646) filed in Japan on Nov. 13, 1998 the entire contents of both of which being incorporated herein by reference.

Obviously, numerous modifications and variations of the present invention are possible in light of the above teachings. It is therefore to be understood that within the scope of the appended claims, the invention may be practiced otherwise than as specifically described herein.

What is claimed is:

1. An image forming apparatus comprising:

an image carrier configured to carry a toner image thereon;

a transfer electrode adjustably positionable to press against said image carrier when electrostatically transferring said toner image from said image carrier to a recording medium when said recording medium is positioned between said transfer electrode and said image carrier, said transfer electrode being made of a material with added ionic agents;

a power source that supplies an electric current to said transfer electrode, said power source being configured to allow said electric current to vary over a predetermined range in reaction to at least one of environmental conditions and toner area density; and a controller configured to adjust said electric current to maintain said electric current to within said predetermined range.

2. The image forming apparatus according to claim 1, wherein:

said material having conductive fine grains dispersed therein.

3. The image forming apparatus according to claim 2, wherein:

said ionic agents influencing a predetermined electrical characteristic of said material to a greater extent than said conductive fine grains.

4. The image forming apparatus according to claim 1, wherein:

said image carrier comprises a photoconductive member.

5. The image forming apparatus according to claim 1, wherein:

said image carrier comprises an intermediate transfer member.

6. The image forming apparatus according to claim 1, wherein:

said transfer electrode comprises a transfer roller.

7. An image forming apparatus comprising:

an image carrier configured to carry a plurality of superimposed color toner images thereon;

a transfer mechanism having a transfer electrode configured to electrostatically transfer said plurality of superimposed color toner images from said image carrier to a recording medium when the recording medium is positioned between the transfer electrode and the image carrier and said transfer mechanism is positioned to press said recording medium against said image carrier, said transfer electrode being made of a conductive material having ionic agents added thereto; and a power source configured to apply a current to said transfer electrode, said power source being configured to allow said current to vary over a predetermined range in response to at least one of environmental conditions and toner area density.

8. The image forming apparatus according to claim 7, further comprising:

means for controlling a target current value of the current output from said power source.

9. The image forming apparatus according to claim 7, wherein:

said material having an electric resistance, ΔR (Va), that is dependent on a voltage (Va) applied from said power source according to a relationship $$\log R(Va) - \log R(10 \times Va) \leqq 0.5.$$

10. The image forming apparatus according to claim 9, wherein:

the electric resistance ΔR (Va) being 0.3 or less.

11. The image forming apparatus according to claim 7, wherein:

said transfer mechanism including a contact separation device that controllably positions said transfer electrode into a contact position and a non-contact position with said image carrier, said transfer electrode remaining in said contact position even though said recording medium is positioned between said image carrier and said transfer electrode.

12. The image forming apparatus according to claim 7, wherein:

said ionic agents influencing a predetermined electrical characteristic of said material to a greater extent than said conductive fine grains.

13. The image forming apparatus according to claim 7, wherein:

said image carrier comprises an intermediate transfer member.

14. The image forming apparatus according to claim 7, wherein:

said transfer electrode comprises a transfer roller.

15. An image forming apparatus comprising:

means for carrying a toner image;

means for electrostatically transferring the toner image to a recording medium, including means for contacting the means for electrostatically transferring with the means for carrying the toner image, said means for contacting including means for controllably separating said means for electrostatically transferring from the means for carrying;

means for supplying an electric current to said means for electrostatically transferring; and means for adjusting said electric current to maintain a said electric current within a predetermined range.

* * * * *